United States Patent [19]

Klingbiel et al.

[11] Patent Number: 4,623,834

[45] Date of Patent: Nov. 18, 1986

[54] DUAL PROGRAMMABLE RESPONSE TIME CONSTANTS FOR ELECTRONIC TAP SWITCHING LINE REGULATORS

[75] Inventors: August G. Klingbiel, Addison; Thomas McCartney, Bannockburn, both of Ill.

[73] Assignee: Oneac Corporation, Bannockburn, Ill.

[21] Appl. No.: 628,407

[22] Filed: Jul. 6, 1984

[51] Int. Cl.[4] ..... G05F 1/20

[52] U.S. Cl. ..... 323/258; 363/90

[58] Field of Search ..... 323/255, 258; 363/90; 361/110

[56] References Cited

U.S. PATENT DOCUMENTS

| | | | |
|---|---|---|---|
| 3,551,789 | 12/1970 | Baker et al. | 323/258 |
| 3,818,321 | 6/1974 | Willner | 323/258 |
| 3,970,918 | 7/1976 | Cooper | 323/258 |
| 4,454,466 | 6/1984 | Ritter | 323/258 |

FOREIGN PATENT DOCUMENTS

| | | | |
|---|---|---|---|
| 4462 | 10/1979 | European Pat. Off. | 323/258 |
| 2125194 | 2/1984 | United Kingdom | 323/258 |

*Primary Examiner*—William H. Beha, Jr.
*Attorney, Agent, or Firm*—Mason, Kolehmainen, Rathburn & Wyss

[57] ABSTRACT

A dual programmable control time constant circuit is provided for a tap switching line voltage regulator of the type which selectively switches in a sequential adjacent one of a predetermined number of taps on a winding of a transformer. The dual programmable control time constant circuit includes a stepping counter and a first bistable device for determining how long a sensed signal representative of the voltage of the load circuit may be permitted to remain outside preset upper and lower limits before corrective action is taken. A second bistable device is used to reset the stepping counter when the sensed signal has changed so as to again fall within the preset limits for a predetermined time. The dual programmable control time constants provide for large variations in load characteristics with the minimum time required per tap change consistent with stable regulator operation. The surge current caused by excessive tap switching is reduced to prevent damage to the regulator and load components.

11 Claims, 2 Drawing Figures

14
20
22
24
26
16
48
52
+V
30
32
34
36
50
L1 OUT
40
42
44
46
N OUT
G
E OUT
CB1
L1
N
G
E INPUT
12
72
LOW VOLTAGE WINDING
10
54
56
58
WINDOW DETECTOR
60
86
88
66
68
102
BOOST STOP
100
INHIBIT
84
64
62
BUCK STOP
98
80
74
ZERO-VOLTAGE DETECTOR AND POWER SUPPLY
148
U/D
CI
J4
J3
J2
J1
CLK
PE
Q4
Q3
Q2
Q1
UP/DOWN COUNTER
D
C
B
A
BIN-DEC DECODER
3
2
1
0
90
92
94
96
82
70
POWER-ON RESET
76
78
156
104
152
106
154
146
112
+V
P
D
Q
F/F
CK
R
108
CK
JOHNSON COUNTER
R
0 1 2 3 4 5 6 7 8 9
110
150
116
130
132
134
136
138
144
114
142
128
126
118
140
122
124
120

DUAL PROGRAMMABLE RESPONSE TIME CONSTANTS FOR ELECTRONIC TAP SWITCHING LINE REGULATORS

FIELD OF THE INVENTION

The present invention relates generally to switching circuits and voltage regulators and more particularly to a dual programmable response time constant control circuit for tap switching line voltage regulators.

BACKGROUND OF THE INVENTION

In the past the control circuit time constants have been tailored to cause the solid state switches in tap switching regulators to respond to as many line voltage variations as possible. These small variations in line voltage cause the regulator output voltage to step up or down once each half cycle. The combination of the power line source impedance, regulator internal impedance and time constant, and load impedance and time constant create a conditionally stable regulator/load combination. This excessive tap switching is normally called "tap dancing" and causes current surging in the thyristor switches and input circuit components in the load which cause increased heating and premature failures in both the tap switching regulator and load.

SUMMARY OF THE INVENTION

It is the principal object of the present invention to provide in a voltage regulator the minimum control circuit response time consistent with stable regulator/-load characteristics.

It is another object of the present invention to provide a voltage regulator with improved regulator stability when large variations in load characteristics occur.

It is another object of the present invention to provide in a voltage regulator individual control time constants for the first and subsequent tap changing request in a programmable recycle time frame.

Still another object of the present invention resides in providing protection for a series of switching elements and input components in the load from excessive surge currents generated by excessive tap switching.

Briefly, these and other objects of the present invention are achieved by providing a dual programmable control time constant circuit for a tap switching line voltage regulator of the type which selectively switches in one of a predetermined number of taps on a winding of a transformer. The tap switching line voltage regulator in response to the sensed load voltage controls the conductive state of a solid state series switching element in each of the switched tap lines. When switching from one tap to another tap, the tap switching line voltage regulator in response to the sensed voltage operates to select a tap adjacent to the tap currently selected. Thus, tap switching proceeds in a sequential fashion up and down along the taps. By this arrangement the dual programmable control time constant circuit provides the minimum control circuit response time necessary for stable regulator/load characteristics. Accordingly, the surge current caused by excessive tap switching is reduced to prevent damage to the regulator and load components.

BRIEF DESCRIPTION OF THE DRAWING

These and other objects and advantages of the present invention will become more apparent by reference to the following description taken in conjunction with the accompanying drawing wherein.

DESCRIPTION OF THE PREFERRED EMBODIMENT

Figure 1:
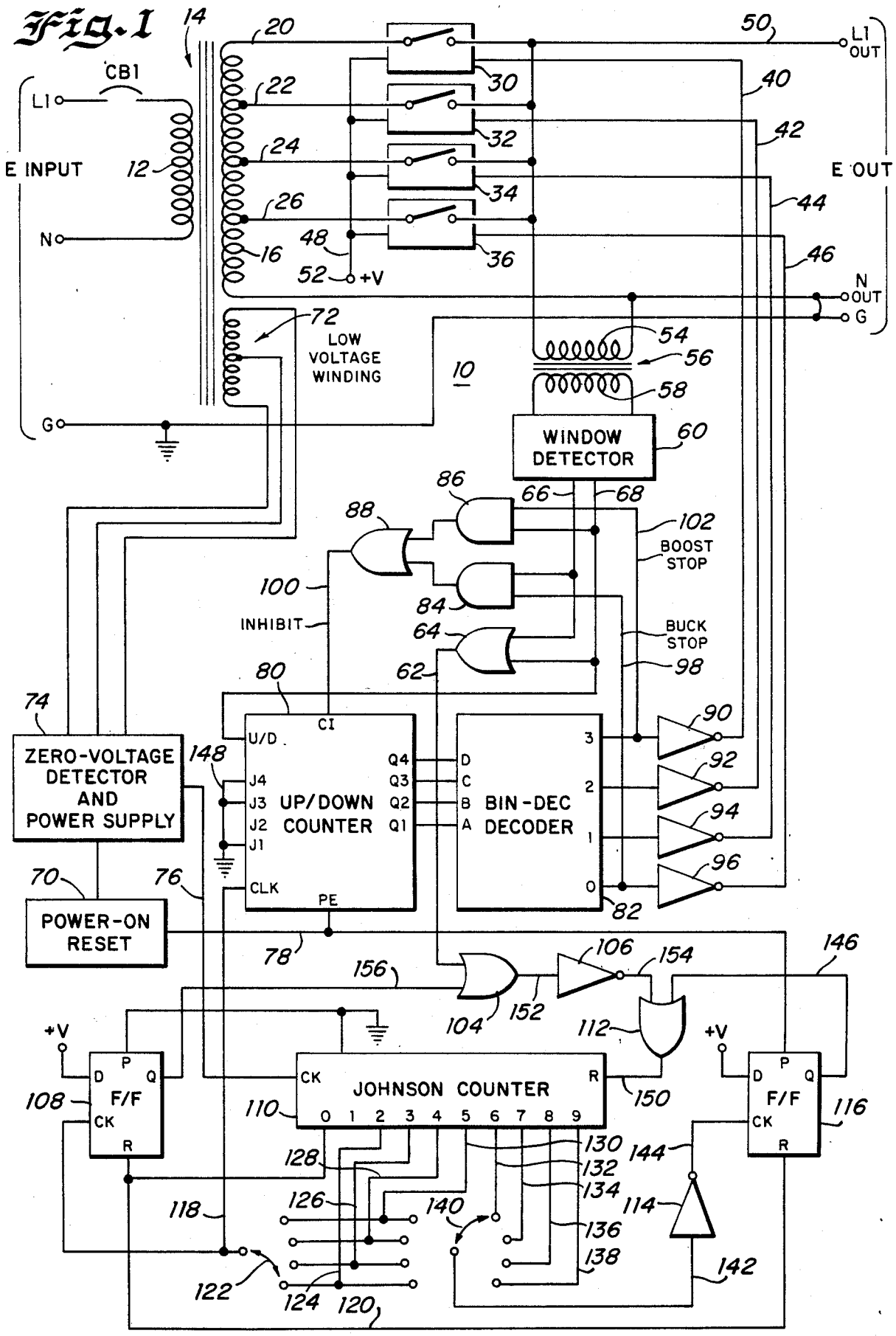
FIG. 1 is an electrical schematic and block diagram illustrating an embodiment of a tap switching line voltage regulator embodying the dual programmable control time constant circuit of the present invention.

Referring to the drawing wherein like reference characters refer to like elements throughout, there is illustrated in FIG. 1 a tap switching line voltage regulator 10 including a dual programmable control time constant circuit in accordance with the principles of the present invention. The tap switching line voltage regulator includes a transformer 14 having a primary winding 12 connected across the live and neutral lines L1 and N respectively of a single phase power input source. The live line L1 includes a conventional breaker CB1 for normal circuit protection.

The transformer 14 also includes a multiple tapped secondary winding 16. One end of the secondary 16 is connected to the neutral output lead $N_{out}$ and in a preferred arrangement the neutral output lead is connected to the safety ground lead G shown connected to earth ground. The other end 20 of the secondary winding is the full tap output of the transformer 14. The secondary winding 16 includes the plurality of tapped secondary lines which in addition to tap 20 already described include taps 22, 24 and 26.

The secondary output at tap 20 is connected through a series solid state switch device 30 to the output 50 designated $L1_{out}$. Similarly each of the tapped secondary lines 22, 24 and 26 are connected through the respective solid state switching device 32, 34, 36 to the output 50. Each of the solid state switching devices 30, 32, 34 and 36 includes a first common control input 48 connected to a suitable supply voltage 52. Further each of the solid state switching devices 30, 32, 34 and 36 includes a respective second control input 40, 42, 44 and 46 connected to logic gates 90, 92, 94 and 96 respectively.

Each of tne solid state switching devices, for example solid state switch 30 is selectively arranged to provide a conduction path so as to connect the line 20 to the line 50 when the appropriate voltage and current conditions exist at the control lines 48 and 40 for switch 30. For example, with a positive supply voltage 52 and a current sinking connection at 40, such as provided by a low level output condition of logic gate 90, the conduction path of the solid state switching device 30 is switched from the open (non-conductive) to closed (conductive) condition.

To sense the output load voltage $E_{out}$ and thus provide a basis for selection of the appropriate secondary tap of the transformer 14, the output voltage between $L1_{out}$ at 50 and the $N_{out}$ signal lead is connected across a primary winding 54 of a transformer 56. The transformer 56 includes a secondary winding 58 connected to a window detector stage 60. The window detector stage 60 operates as an analog comparator to compare the absolute value of the voltage across secondary winding 58 to preset upper and lower limits. If the sensed voltage across winding 58 is between the predetermined upper and lower limits, the output 62 of the window detector 60 is a logic zero level. The output 62 is provided at the output of a two input OR gate 64. The two inputs to the OR gate 64 are connected respectively to the high and low outputs 66 and 68 of the window detector stage 60. If the sensed voltage is outside the preset limits the output at 62 is a logic one level.

The tap switching line voltage regulator 10 also includes a power-on reset stage 70 which on initial power rise provides at 78 a logic pulse to preset an up/down counter stage 80 and a bistable device such as a "D" FF stage 116. The transformer 14 also includes a center tapped low voltage winding 72 that is connected to a zero voltage detector and power supply stage 74. The zero voltage detector and power supply stage provide a clock signal at 76 coincident with the zero crossings of the sample input voltage from the winding 72. Further the stage 74 also supplies suitable operating voltages to the various circuitry of the tap switching line voltage regulator 10.

The output 62 of the window detector stage and the Q output 156 of FF stage 108 are connected to the respective inputs of a two input OR gate 104. The output 152 of this OR gate 104 is inverted in stage 106 and connected to the respective inputs of a two input OR gate 112 along with the Q output at 146 of FF stage 116. The output of the OR stage 112 is connected via line 150 to the reset input of a stepping counter such as the Johnson Counter stage 110. The clock signal 76 is connected to the clock input of the Johnson Counter stage 110. The 0 output line of the Johnson Counter 110 is connected by line 120 to the reset inputs of FF stages 108 and 116. The 2, 3, 4 and 5 outputs of the Johnson Counter via lines 124, 126, 128 and 130 and jumper 122 are selectively connected to the clock inputs of the FF 108 and the up/down counter 80 via line 118. The "2", "3", "4", "5", "6", "7", "8" and "9" outputs of the Johnson Counter via lines 124, 126, 128, 130, 132, 136 and 138 and jumper 140 are selectively connected to the inverter stage 114 by line 142. The output 144 of the inverter 114 is connected to the clock input of FF stage 116. The D inputs of FF stages 108 and 116 are tied to the positive supply voltage.

The up/down counter 80 includes preset inputs J1, J2, J3 and J4 which in the example illustrated in FIG. 1 includes J1, J3 and J4 connected to ground at 148, J2 being open. The up/down counter 80 also includes an up/down control line U/D connected to the low output 68 of the window detector stage 60. Further the up/-down counter 80 includes a count "inhibit" line connected at 100 to the inhibit output of a logic gate array at the output of a two input OR gate 88. Each input of the OR gate 88 is connected to the output of a respective two input AND gate 84 and 86. One input to the AND gate 86 is connected to the low output 68 of the window detector stage 60. The second input to the AND gate 86 is connected to a "boost stop" line 102. One input of the AND gate 84 is connected to the high output 66 of the window detector stage 60. The second input to this AND gate is connected to a "buck stop" line 98.

The binary outputs Q1, Q2, Q3 and Q4 of the up/-down counter stage 80 are connected respectively to the A, B, C and D inputs of a binary to decade decoder stage 82. The binary to decade decoder stage includes outputs 0, 1, 2, and 3 connected respectively to the outputs of the respective inverter gates 96, 94, 92 and 90. The outputs of the inverter gates 90, 92, 94 and 96 are connected respectively to one of the control leads 40, 42, 44 and 46 of the solid stage switching device for appropriate control thereof in accordance with the number of secondary taps and solid state switching devices. For example, in the arrangement of FIG. 1 with four secondary taps and four solid stage switching devices, the control lead 40 of the solid state switching device 30 is connected to the output of the inverter gate 90. Similarly, the control leads 42, 44 and 46 of the respective solid state switching devices 32, 34 and 36 are connected to the output of the inverter gates 92, 94 and 96 respectively.

The zero output of the decoder stage 82 is connected to the "buck stop" line 98. Further, the "boost stop" line 102 is connected to the "3" binary output of decoder stage 82.

The control function provided by the control circuitry of the tap switching line voltage regulator 10 for proper system operation is sequential selection of adjacent taps. Sequential selection is maintained under circuit control from the highest to lowest tap that is from tap 20 to tap 26 by incrementing through each intermediate step with no missing steps. The initial tap selection for power turn-on is preselected by having a presettable state of the up/down counter 80 and the power-on reset stage 70. The arrangement of the counter and the decoder ensures that only one control signal to the control inputs 40, 42, 44 and 46 of the solid state switching devices 30, 32, 34 and 36 respectively will be turned on or actuated at any one time.

Considering operation of the tap switching line voltage regulator circuit 10 in more detail, when power from the input is applied to winding 12 of transformer 14, the power reset circuit 70 sends a logic pulse at 78 to the up/down counter 80 to set the output to the preset condition such that the decoder 82 decodes the preset condition as a predetermined selected tap switch. For example, in the arrangement of FIG. 1, the preset condition is the binary output state "2" of the decoder 82 which selects the 22 tap and thus turns on the control signal to solid state switching device 32.

At the next occuring zero crossing of the input sine-wave, the solid state switching device 32 turns on and supplies voltage to the load and also the output voltage sensing circuit through winding 54 and transformer 56. The window detector stage 60 determines if the value of the load voltage is within the predetermined upper and lower limits. If the output level is within the desired range, the output of the window detector 62 is a logic zero level and no action is required.

If the present value of the sensed output voltage is not correct and within the sensed window limits, the window detector stage at 62 will output a logic one level. The initial condition of the FF stages 108 and 116 is for the Q outputs thereof to both be at a logic zero. The logic one from the window detector 62 ORed with the Q output of FF stage 108 is then inverted by 106 to a logic zero. The output at 154 ORed with the Q output of FF stage 116 is a logic zero at the reset input of the Johnson counter stage 110. The logic zero at 150 removes the reset condition from the input to the counter stage 110. The clock pulse generated at the next zero voltage crossing of the input sine-wave advances the Johnson counter to the next counter state "1". If the sensed load voltage is not outside the preset limits for a continuous number of half cycles determined by selectively jumpering 122 (programming one of the counter outputs "2", "3", "4" or "5" from the Johnson counter 110 to the clock input of FF stage 108 and up/down counter stage 80), the Johnson counter will be reset to zero count allowing the elimination of short disturbances from incrementing the regulator to an adjacent tap which would raise or lower the output voltage outside the preset limits. The regulator would have to increment back to the correct tap at the next zero voltage crossing of the input sine-wave.

If the sensed load voltage is continuously outside the preset limits for the "programmed" number of half cycles (as determined by jumper 122) then a clock pulse will be generated at 118 from one of the zero voltage crossing pulses from the Johnson counter outputs.

The clock pulse that was generated at 118 increments the up/down counter 80 and clocks FF 108 Q output to a logic one state. With the Q output 156 clocked high, the window detector output at 62 is temporarily removed from controlling the status of the signal at 154. This action allows the Johnson counter to be advanced to the second programmable jumper 140.

The up/down counter stage 80 will be incremented to the next binary state in accordance with the status of the up/down line 68 and the inhibit line 100. If the sensed output voltage is low then the up/down status line which is the window detector low line 68 will be a high logic level. Correspondingly if the output voltage is high then the up/down status line 68 will be a low logic level while the window detector high line 66 will be a logic one level.

In response to the changed state of the counter outputs Q1–Q4, the decoder 82 changes state to remove the control signal from the currently actuated solid state switching device 30, 32, 34 or 36 and to provide a control signal to an adjacent switching device. If the new resulting output voltage is within the predetermined limits then the window detector stage 60 would provide a logic zero at 62. The zero crossing clock signal 76 will continue to advance the Johnson counter (once each half cycle) through each counter state until the selected (programmable) count state clocks FF 116 via the inverter stage 114. When the FF 116 Q output is clocked high, the OR gate 112 output will reset the Johnson counter to zero count. The zero count output from the Johnson counter will reset FF 108 and FF 116. If the window detector output at 62 is a logic zero resulting from the last tap change then the inputs to the OR gate 104 are now both a logic zero level. This level, inverted by 106 forces a logic one into OR gate 112 which keeps the Johnson counter 110 in the reset state.

If the new sensed output voltage from the last tap switching event is still outside of the limits of the window detector 60, then the detector output stage 60 would provide a logic one at 62 which removes the reset condition from the Johnson counter reset input line 160. With the reset condition removed, the Johnson counter may be clocked to the next counter state at the next zero crossing of the input sine-wave. The clocking of the Johnson counter will continue until the sensed voltage from the window detector stage 60 is within the preset limits. Each time the Johnson counter passes through the first selected counter state, FF 108 will be set and the up/down counter 80 will be incremented according to the status of the up/down status line and the inhibit line. If the counter was advanced to the physical limits of the system as determined by the total number of tap positions available, then the boost stop signal at 102 or the buck stop signal at 98 generates an inhibit signal at 100 to stop the counter from incrementing in the same direction for any additional clock pulses. The control action continues until the sensed voltage is within the predetermined limits.

The solid state switching devices such as 30 can be implemented by component packaged solid state relays that are of the zero voltage switching type. These devices can be Triac type thyristors or back to back SCR type thyristors. Either type of switch can be designed to be controlled via low voltage AC or DC voltages. The arrangement in FIG. 1 and FIG. 2 illustrates DC type control.

Figure 2:
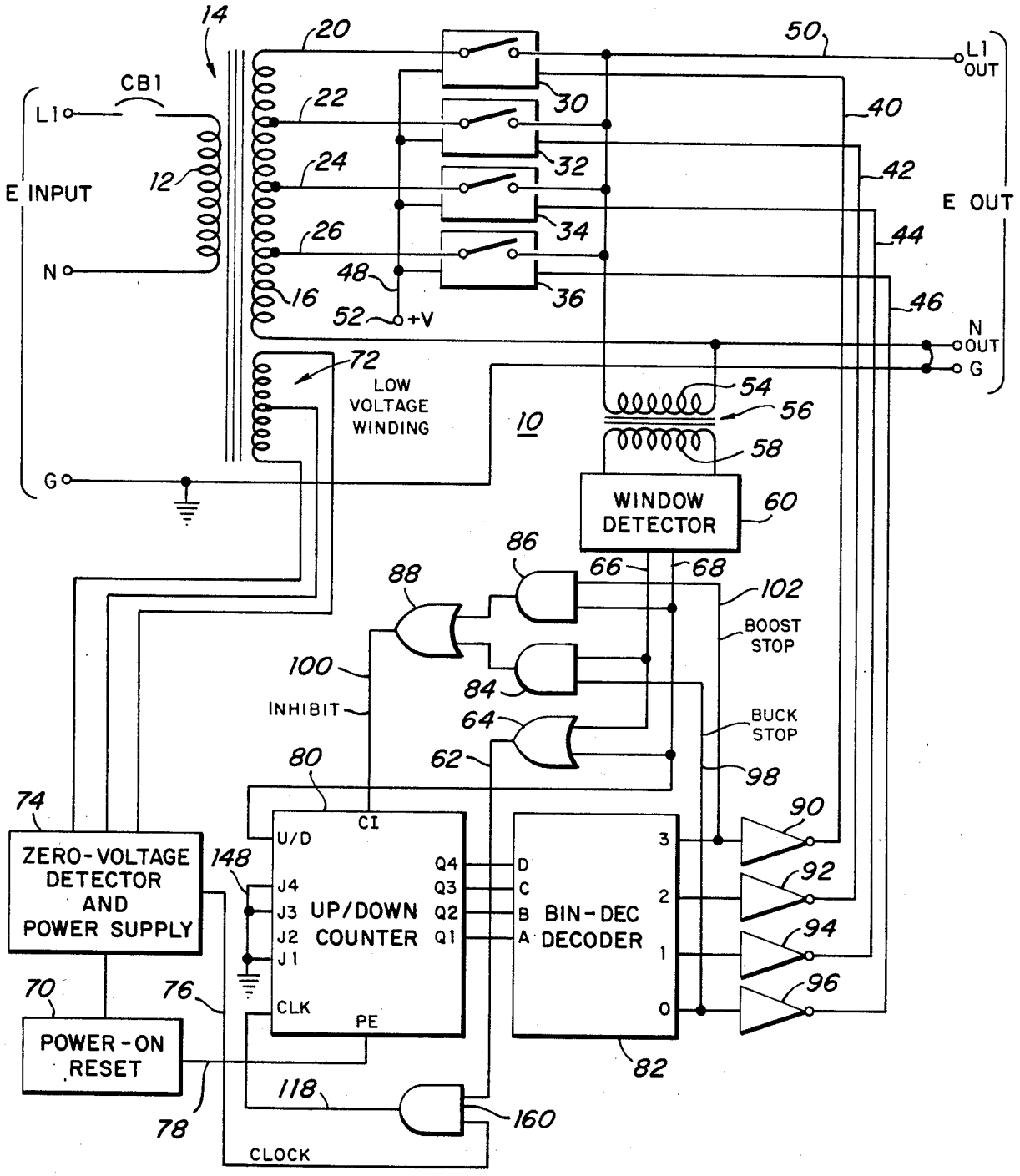
Fig. 2 (PRIOR ART)
FIG. 2 is an electrical schematic and block diagram illustrating a typical tap switching line voltage regulator to which the present invention is applicable.

Referring now to FIG. 2, which does not disclose the FF stages and Johnson Counter of the present invention, it shows the window detector output at 62 ANDed with the zero crossing clock signal 76 in stage 160 to produce a clock signal for the up/down counter stage 80 only when the sensed output voltage is not within the preset window limits. The up/down counter will increment up or down at each zero crossing of the input sine-wave according to the status of the U/D line and the count inhibit line 100.

For implementation of the tap switch line voltage regulator 10 of FIG. 1, the following logic circuits are illustrative of one specific embodiment which is given by way of example and not to be interpreted in any limiting sense:

| FUNCTION | (RCA)CD4000 | (Signetics) 74LS00 |
|---|---|---|
| Decoder 82 | CD4028 | 74LS42 |
| Up/Down 80 | CD4029 | 74LS191 |
| Inverter 90, 92, 94 and 96, 106, 114 | CD4049 | 74LS07 |
| "OR" 64, 88, 104, 112 | CD4071 | 74LS32 |
| "AND" 84, 86 | CD4081 | 74LS08 |
| Johnson Counter | CD4017 | 74L164 |
| "D" F 108, 116 | CD4013 | 74LS74 |

While there have been illustrated and described particular embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. In a voltage regulator of the tap changing type for a load circuit, wherein individual time constants for the first and subsequent tap changing requests are controlled in a recycle time frame, comprising a transformer including a primary winding connected to an alternating current source and a secondary winding having a plurality of taps each connected to a different tap line, means for selectively connecting the load circuit to one of said tap lines, detector means for sensing a signal representative of the voltage of said load circuit and comparing it to preset upper and lower limits, means responsive to the sensed signal to produce sequential selection of adjacent taps, said last mentioned means discriminating between a first and second tap change whereby said first tap change occurs following a first predetermined delay, but said second successive tap change occurs following a second predetermined delay, where said first delay is less than said second delay thereby to avoid undesirable tap changing.

2. The voltage regulator of claim 1, wherein said means responsive to the sensed signal comprises a stepping counter and two bistable devices connected to said counter.

3. The voltage regulator of claim 2 wherein said stepping counter is a Johnson Counter and said bistable devices are type D flip flops.

4. In a voltage regulator of the tap changing type for a load circuit, wherein individual time constants for the first and subsequent tap changing requests are controlled in a recycle time frame, comprising a transformer including a primary winding connected to an alternating current source and a secondary winding having a plurality of taps each connected to a different tap line, means for selectively connecting the load circuit to one of said tap lines, detector means for sensing a signal representative of the voltage of said load circuit and comparing it to preset upper and lower limits, means responsive to the sensed signal to produce sequential selection of adjacent taps, said last mentioned means discriminating between first and successive tap changes whereby said first tap change occurs following a first predetermined delay, but successive tap changes occur following a second predetermined delay, where said first delay is less than said second delay thereby to avoid undesirable tap changing.

5. The voltage regulator of claim 4, wherein said delays are independently programmable.

6. In a voltage regulator for a load circuit having the minimum control circuit response time consistent with a stable regulator load characteristic, comprising a transformer including a primary winding for receiving electrical energy from an alternating current source and a secondary winding having a plurality of taps each connected to a different tap line, means for selectively connecting the load circuit to one of said tap lines, detector means for sensing a signal representative of the voltage of said load circuit and comparing it to preset upper and lower limits, means responsive to the sensed signal to produce sequential selection of adjacent taps, said last mentioned means comprising a stepping counter and bistable device for determining how long the sensed signal may be permitted to remain outside said preset limits before corrective action is taken, thereby preventing short electrical disturbances from causing a tap change but insuring corrective action if the duration of the disturbance exceeds a predetermined time interval.

7. The voltage regulator of claim 6, wherein a second bistable device is connected to said stepping counter for resetting said counter when the sensed signal has changed so as to again fall within said preset limits for a predetermined time.

8. The voltage regulator of claim 7 wherein said stepping counter is a Johnson Counter and said bistable devices are type D flip flops.

9. A voltage regulator for a load circuit having improved stability when large variations in load characteristics occur, comprising a transformer including a primary winding and a secondary winding having a plurality of taps each connected to a different tap line, means for selectively connecting the load circuit to one of said tap lines, detector means for sensing a signal representative of the voltage of said load circuit, and comparing it to preset upper and lower limits, means comprising a stepping counter and two bistable devices for determining how long the sensed signal may be permitted to remain outside the preset limits before causing selection of a different tap and for determining how long the sensed signal must be changed to fall within the preset limits before terminating a further tap change.

10. A device for protecting from excessive surge currents a series of switching elements and input components interconnecting an alternating current source and a load, comprising a transformer including a primary winding and a secondary winding having a plurality of taps each connected to a different tap line, means for selectively connecting the load circuit to one of said tap lines, detector means for sensing a signal representative of the voltage of said load circuit, and comparing it to preset upper and lower limits, means comprising a stepping counter and two bistable devices for determining how long the sensed signal may be permitted to remain outside the preset limits before causing selection of a different tap and for determining how long the sensed signal must be changed to fall within the preset limits before terminating a further tap change.

11. The voltage regulator of claim 10 wherein said stepping counter is a Johnson Counter and said bistable devices are type D flip flops.

* * * * *